United States Patent [19]

Dunlop et al.

[11] Patent Number: 5,000,160

[45] Date of Patent: Mar. 19, 1991

[54] PROXIMITY VENTILATED COOKING SYSTEM

[75] Inventors: John S. Dunlop, Fishers; Michael A. Strader, Indianapolis, both of Ind.; William T. Vaughn, Louisville, Ky.

[73] Assignee: Maytag Corporation, Newton, Iowa

[21] Appl. No.: 447,055

[22] Filed: Dec. 7, 1989

[51] Int. Cl.[5] ..... F24C 15/20

[52] U.S. Cl. ..... 126/299 D; 126/299 R

[58] Field of Search ..... 126/299 R, 285 R, 289, 126/290, 291, 292, 21 R, 21 A, 299 D, 80

[56] References Cited

U.S. PATENT DOCUMENTS

| | | | |
|---|---|---|---|
| 2,085,511 | 6/1937 | Ross et al. . | |
| 2,482,952 | 9/1949 | Warren | 126/299 R |
| 2,828,683 | 4/1958 | Joseph et al. . | |
| 3,128,938 | 4/1964 | Ariewitz . | |
| 3,204,870 | 9/1965 | Dibert | 126/290 X |
| 3,756,217 | 9/1973 | Field . | |
| 3,803,690 | 4/1974 | Cann et al. . | |
| 4,253,796 | 3/1981 | Philipps et al. . | |
| 4,263,890 | 4/1981 | Turko et al. | 126/292 X |
| 4,428,357 | 1/1984 | Field | 126/299 R |
| 4,456,033 | 6/1984 | Kay et al. . | |
| 4,527,542 | 7/1985 | Bales et al. | 126/299 R X |
| 4,562,827 | 1/1986 | Cerola | 126/299 R |
| 4,750,433 | 6/1988 | Guzorek | 126/292 X |

*Primary Examiner*—Larry Jones

*Attorney, Agent, or Firm*—Willian Brinks Olds Hofer Gilson & Lione

[57] ABSTRACT

A proximity ventilated cooking system for interior use is provided with means for providing effective exhaustive ventilation to maintain in a variety of installations an air flow velocity adjacent the burners and throughout the exhaust system that has sufficient velocity to capture and carry to atmosphere substantially all of the cooking gasses, vapors and fumes produced in cooking, but insufficient velocity adjacent the burners to produce undesirable cooking and burner heat distribution, and where gas burners are used, interference with desirable flame patterns.

39 Claims, 4 Drawing Sheets

PROXIMITY VENTILATED COOKING SYSTEM

BACKGROUND OF THE INVENTION

This invention relates to apparatus and methods for providing effective exhaustive ventilation for proximity ventilated cooking systems.

In self-ventilated cooking systems, such as cooktops and grill ranges with proximity ventilation, cooking gases, vapors and odors are drawn into an exhaust inlet and are exhausted into the atmosphere. Usually, the exhaust inlet is located adjacent the cooking surface and is the inlet to a flow path which serially includes a plenum, a blower, an atmospheric exhaust and interconnecting ductwork. The flow path to the atmosphere normally extends through a wall or floor of the room in which the cooking system is located.

The blower is frequently made a separate unit from the rest of the cooking apparatus and is installed prior to the installation of the rest of the apparatus. The blower is provided with a pair of brackets which permit the selective mounting of the blower to the floor for discharge either through-the-wall or through-the floor, as required by the installation. Because the blower is installed separately, it can be located for ease of access and to avoid the joists or studs, which can be a problem in retrofit installations. For a through-the-floor exhaust, the blower is secured to the floor with the outlet extending through the floor. However, for a through-the-wall installation, the blower is secured to the floor with the outlet of the blower extending horizontally. The outlet of the blower is connected to atmosphere by a flexible ductwork which extends through the wall to an external exhaust outlet. After the blower is secured in place and connected to the atmospheric exhaust, the self-ventilated cooking apparatus is set in place over the blower and connected to the electrical service. The self-ventilated cooking apparatus can have a full height plenum, which can be made thinner to accommodate a full size oven, or to permit the installation of a full size oven where the cooking surface is adapted for countertop installation, while still providing proximity ventilation of the cooktop. The flow path is completed by connecting the blower and the plenum of the range by means of a length of flexible pipe, and the blower is plugged into the self-ventilated cooking apparatus and thereby the electrical system of the apparatus. Such self-ventilated cooking systems are disclosed in U.S. Pat. No. 4,428,357.

The installation of such cooking systems in a building presents significant problems. The air flow path from the blower to atmosphere varies widely from building to building in its length and its effective resistance to air flow. In some buildings, the air flow path may be long and torturous while in other buildings, the air flow path may be short and free from restrictions. Such variations in the air flow path have limited the installation of such cooking systems, particularly where gas was used to provide heat for grilling and cooking. Where the exhaust paths were short and free from restrictions, such systems provided too much air flow at the cooking surface and did not provide uniform cooking and heat distribution and, where gas heat was used, proper flame formation and combustion. Where the exhaust paths were long or torturous, the system provided too little air flow at the cooking surface and was ineffective in capturing cooking gases and vapors and in carrying grease particles to atmosphere. Variations in the structure of buildings and in the length and complication of the exhaust path between the blower and atmosphere through the walls of the building could therefore produce ineffective exhaustive ventilation.

SUMMARY OF THE INVENTION

The invention provides proximity ventilated cooking systems for interior use with means for providing effective exhaustive ventilation. By providing effective exhaustive ventilation, we mean maintaining an air flow velocity adjacent the burners and throughout the exhaust system that has sufficient velocity to capture and carry to atmosphere substantially all of the cooking gasses, vapors and fumes produced in cooking comestibles, such as meats and vegetables, but insufficient velocity adjacent the burners to produce undesirable cooking and burner heat distribution, and, where gas burners are used, interference with desirable flame patterns.

A proximity ventilated cooking system of the invention includes an upwardly facing cooking surface; and an exhaustive ventilation means for the upwardly facing cooking surface. The exhaustive ventilation means includes a plenum, or other air flow passage forming means, having an entrance adjacent the upwardly facing cooking surface, a blower, or other air flow producing means, connected to the air flow passage-forming means, an exhaustive duct forming an air flow passage from the blower or other air producing means to the outside of the building, and means for providing effective exhaustive ventilation at said upwardly facing cooking surface and throughout the exhaustive ventilation means.

The means for providing an effective exhaustive ventilation can include a restriction means in the air flow path of the cooking apparatus providing an effective air flow opening of less than a predetermined cross-sectional area to limit the volume of air flow into the exhaustive ventilation means for installations in which the exhaustive duct has less than a predetermined effective length; and a restriction modification means associated with said restriction means for providing an effective air flow opening of increased cross-sectional area to permit an increased volume of air flow into the exhaustive ventilation means for installations in which the exhaustive duct means has an effective length greater than said predetermined effective length.

The invention includes various means for providing effective exhaustive ventilation and an apparatus permitting effective exhaustive ventilation to be easily effected during installation. The presently preferred such means comprises a truncated conical annulus used as a restriction means removably fastened at a conically-formed inlet of a centrifugal blower by restriction modification means in the form of a spring fastener with a plurality of annulus engaging portions carried by the blower inlet and adapted to engage and removably retain the annulus in the blower inlet.

The invention provides a proximity ventilated cooking apparatus and an installation method adapted for a wide variety of installations while maintaining effective exhaustive ventilation, selective installation and mounting of the cooking apparatus and its component parts, and reduced operating noises and vibrations.

Other features and advantages of the invention will be apparent from the drawings and descriptions that follow.

DESCRIPTION OF THE PREFERRED EMBODIMENTS

Figure 1:
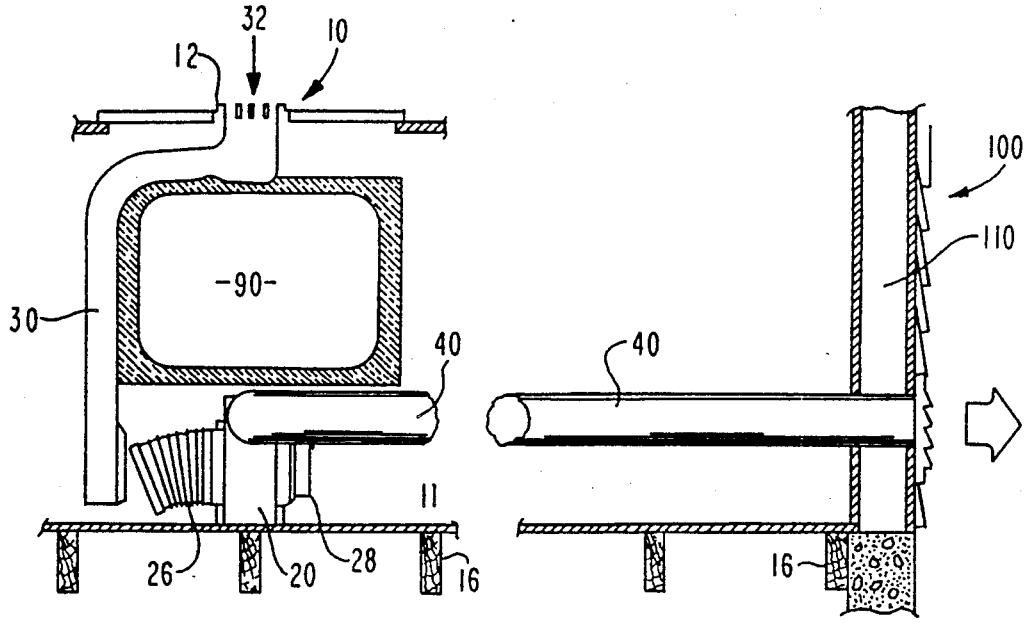
FIG. 1 is a diagrammatic drawing of a proximity ventilated cooking apparatus installation to illustrate the invention.

FIG. 1 illustrates an installation of a self-ventilated grill range 10 within a building 100. Although the invention is shown and described using a grill range as an example, the invention can be incorporated into any proximity ventilated cooking apparatus. The upwardly facing cooking surface 12 of the grill range is provided with an exhaustive ventilation means comprising an air flow producing means 20, preferably a centrifugal blower, an air flow passage forming means, or plenum, 30 with an entrance 32 adjacent the upwardly facing cooking surface 12, and an exhaustive duct 40 forming an air flow passage from the centrifugal blower 20 through the building walls 110 to the outside of the building.

In the installation of self-ventilating grill ranges, the exhaustive duct 40 passes through various walls 110 and floors 11 of the building and the exhaustive duct 40 can reach lengths of 60 feet. Long runs of exhaustive duct work 40 can reduce the air flow and air velocity at the upwardly facing cooking surface 12 and within the plenum 30, blower 20 and exhaustive duct 40 and result in insufficient air flow at the cooking surface and within the exhaustive ventilation means to capture and carry cooking gases, vapors, greases and fumes to atmosphere exterior of the building.

With the invention, the installed system is provided with a means for providing effective exhaustive ventilation. Effective exhaustive ventilation provides an air flow velocity adjacent the burners of cooking surface 12 and throughout the exhaust system (20, 30, 40) that has sufficient velocity to capture and carry to atmosphere substantially all of the cooking gasses, vapors, greases and fumes produced in cooking comestibles, such as meats and vegetables, but insufficient velocity adjacent the burners of cooking surface 12 to produce undesirable cooking and heat distribution adjacent the burners, or where gas burners are used, to interfere with combustion and desirable flame patterns. An effective exhaustive ventilation includes a total air flow of from about 300 CFM to about 350 CFM, and preferably about 330 CFM and an air velocity in excess of about 1500 ft. per min. within the exhaustive ventilation means throughout the exhaust system.

FIGS. 2 through 6 illustrate various means for providing systems of this invention with effective exhaustive ventilation.

Figure 2:
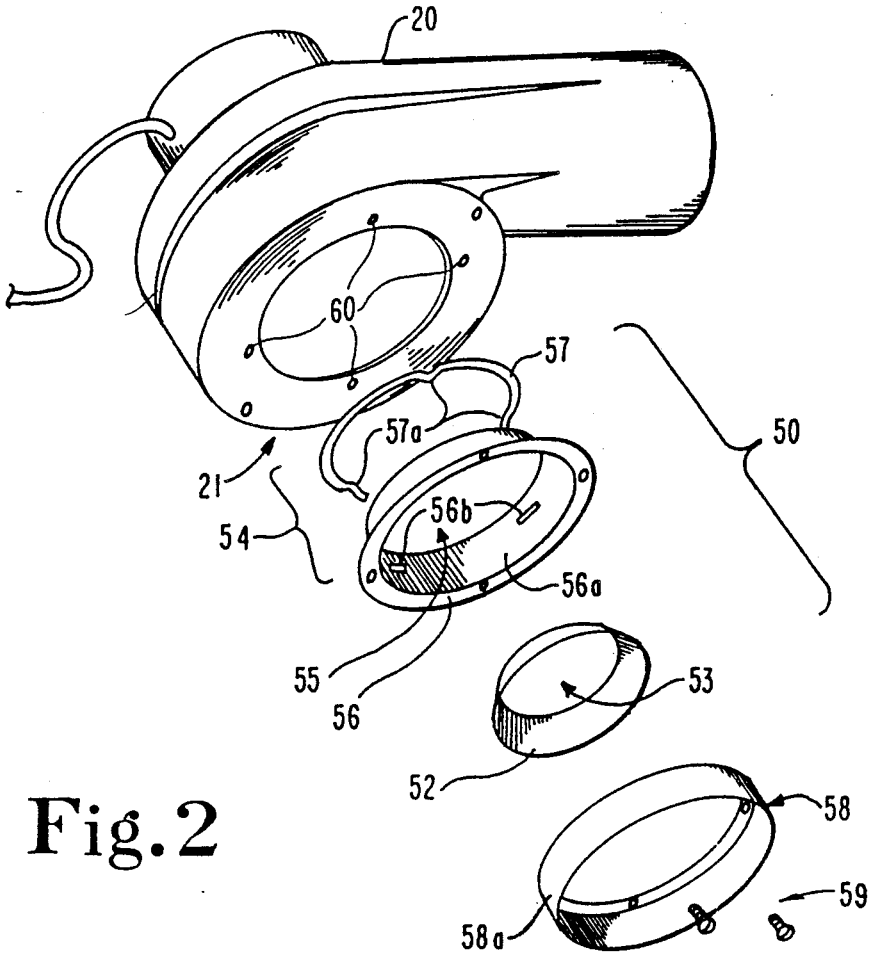
FIG. 2 is an exploded view of a preferred embodiment of means for providing effective exhaustive ventilation in this invention.

FIG. 2 is an exploded view illustrating a presently preferred means for providing effective exhaustive ventilation in a cooking apparatus of this invention. As shown in FIG. 2, the means 50 for providing effective exhaustive ventilation is located at the inlet 21 of the air flow producing centrifugal blower 20. Means 50 preferably comprises a restriction means 52 and a restriction modification means 54 at the blower inlet 21 deformably engaged to permit effective exhaustive ventilation to be easily effected upon installation. The restriction means 52 is an annulus forming an effective air flow opening 53 of less than a predetermined cross-sectional area. The air inlet 21 of the blower in this embodiment is a hole 55 of a predetermined cross-sectional area formed by part 56 of the restriction modification means. The restriction modification means 54 also comprises a fastener 57 to retain the annulus 52 in a position surrounding the air inlet opening 55 and reducing the cross-sectional area at the blower inlet.

Preferably, part 56 forms the air inlet 21 with a truncated conical surface 56*a* and annulus 52 is formed as a truncated cone. The fastener 57 retains annulus 52 nested within the truncated conical surface 56*a* forming an air inlet opening 53 of less than a predetermined cross-sectional area.

In this preferred embodiment, the area 55 of the air inlet opening is chosen to provide, with the air flow producing capacity of blower 20, effective exhaustive ventilation in installations where the effective length of the exhaust duct 40 is, for example, 30 to 60 feet, and the area 53 of the annulus 52 is chosen to provide, with the air flow producing capacity of blower 20, effective exhaustive ventilation in installations where the effective length of the exhaust duct 40 is less than 30 feet. The effective length on an exhaust duct is determined by adding to its actual length an effective length for elbows, reducers and other air flow restricting portions of the exhaustive ventilation path.

To permit the annulus restriction means 52 to be easily removed in installation of cooking systems of this invention, the restriction modification means 54 is provided a manually-operable, deformable fastening means 57. As shown in FIG. 2, the truncated conical surface 56*a* of the air inlet 21 forms a plurality of openings 56*b*, and fastener 57 provides spring loaded projections 57*a* carried behind the truncated conical surface 56*a* to extend through the openings 56*b*. The spring loaded projections 57*a* permit conical annulus 52, and other restriction means such as a perforated plate, to be pressed into and to retained in place within the truncated covered surface 56*a* and to be easily pulled from within the truncated conical surface 56*a* for installations with exhaust ducts have an effective length of over 30 feet. As indicated in FIG. 2, the pluralities of openings 56*b* are elongated and the spring loaded projections 57*a* comprise a plurality of bent portions of the spring wire fastener 57. In assembly, fastener 57 substantially surrounds the outside of the truncated conical surface 56*a* with the plurality of bent portions 57*a* projecting through the plurality of openings 56*b*.

As further shown in FIG. 2, part 56 of restriction modification means 54 and a coupler 58 are fastened at the air inlet 21 by a plurality of screw fasteners 59 engaging a plurality of threaded holes 60 at the air inlet. The coupler 58 provides a flange 58*a* for engagement by a flexible duct 26.

Figure 4:
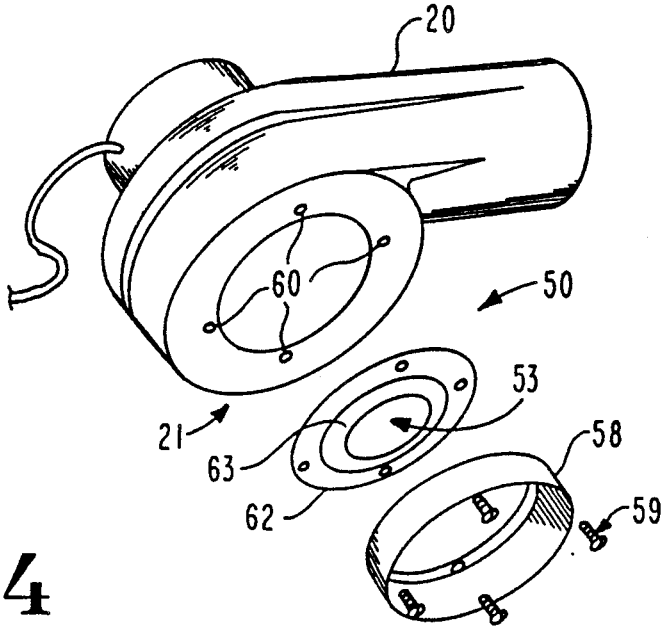
FIGS. 3 and 4 are exploded views of further embodiments of means for providing effective exhaustive ventilation in this invention.
Figure 3:
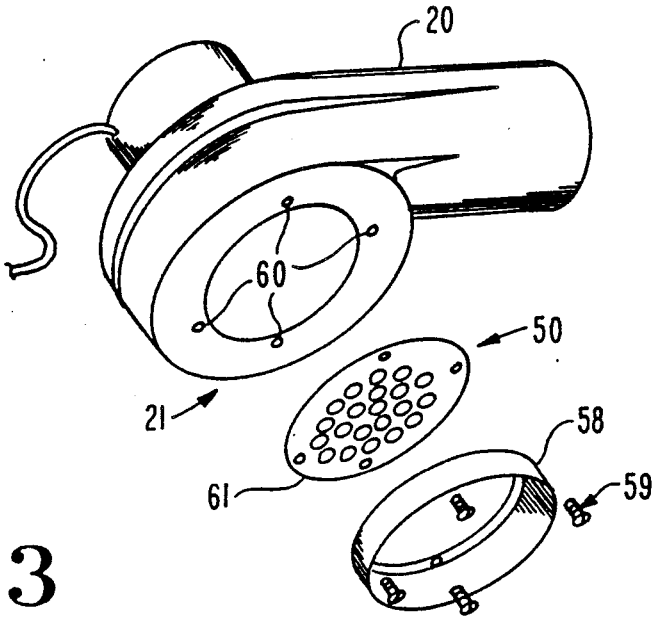

Although FIG. 2 shows the means 50 for providing effective exhaustive ventilation as a restriction means 52 in the form of a removable annulus, means 50 can take other forms. As shown in FIG. 3, the means 50 for providing effective exhaustive ventilation can comprise a perforated panel 61 as a restriction means. The one or more fasteners 59 can removably hold the perforated panel 61 over the air inlet 21 and provide restriction modification means. As shown in FIG. 4, means 50 for providing effective exhaustive ventilation can comprise as a restriction means a panel 62 forming an effective air flow opening 53 of less than a predetermined cross-sectional area, and the restriction modification means comprises at least one pre-scored knock-out portion 63 in said panel.

Figure 5A:
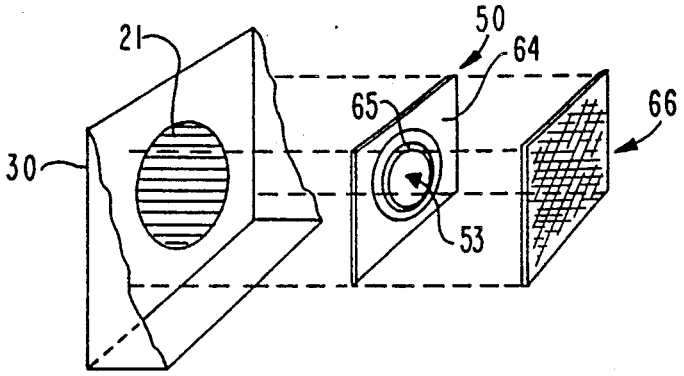
FIGS. 5*a*, 5*b*, 5*c*, 5*d* and 6*a* and 6*b* illustrate still further means for providing effective exhaustive ventilation in this invention.

FIGS. 5A–5D show a plurality of other means 50 for providing effective exhaustive ventilation comprising restriction means removably fastened to the outlet of a plenum 30 and located adjacent the air inlet 21 of the blower 20. As shown in FIG. 5A, means 50 can comprise a removable panel 64 having an opening 53 of less than a predetermined cross-sectional area and provided with restriction modification means 65 in the form of a pre-scored removable panel to permit installation of systems with effective exhaust duct lengths of over 30 feet. In the system shown in FIG. 5A, an air filter 66 can be provided at the air inlet of the blower. If desired, the panel 64 may be removably fastened to air filter 66 to extend the variation of the air flow restriction available with the system shown in FIG. 5A.

Figure 5D:
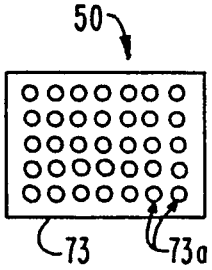
Figure 5B:
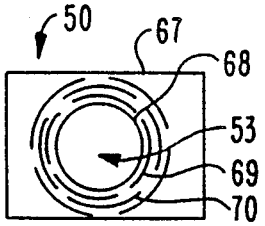
Figure 5C:
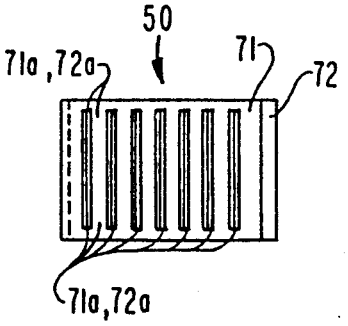

FIGS. 5B and 5C also show systems providing extensive variation in the available effective exhaustive ventilation. Means 50 of FIG. 5B shows a panel 67 having a plurality of pre-scored removable panels 68, 69, 70 surrounding opening 53. FIG. 5C shows a means 50 for providing effective exhaustive ventilation by adjusting the effective cross-sectional area of opening 53 as formed by the overlapping rectangular openings in a pair of panels 71 and 72 that may be moved with respect to one another. As shown in FIG. 5C, each panel 71 and 72 forms one or more openings **71*a*, 72*a*. The panels 71, 72 are movable with respect to one another to provide, through the overlapping positions of their one or more openings 71*a*, 72*a*, an effective air flow opening 53 of less than a predetermined cross-sectional area. The panels are provided with means permitting the relative movement of the pair of panels to modify their air flow restriction and provide an effective air flow opening of increased cross-sectional area. As shown in FIG. 5D, the means 50 providing a restriction means can also be panel 73 with one or more openings 73*a* providing the effective air flow opening 53 of less than a predetermined cross-sectional area. The openings 73*a*** of such a panel can be a plurality of perforations, a plurality of slots or other such openings.

It is not necessary that the means 50 for providing effective exhaustive ventilation be located at the air inlet of the blower. The means 50 can be located at other locations within the exhaustive ventilation means of an installation. For example, a means 50 of the type shown in FIGS. 5A through 5D (e.g., a panel such as 64, 67, 71 and 72, or 73) can be located in the plenum 30 adjacent its entrance 32. The panel can be adapted to be carried by a removable air filter in the plenum chamber and the effective restriction to air flow can be modified by fastening means to permit the removal of the panel from the air filter.

Figure 6A:
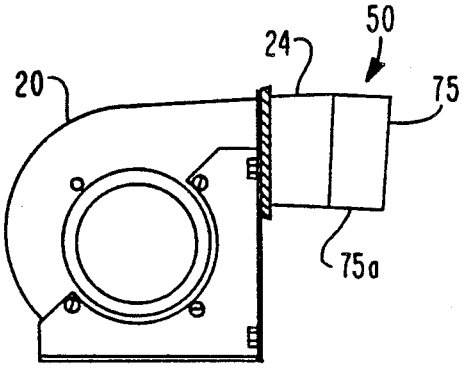
Figure 6B:
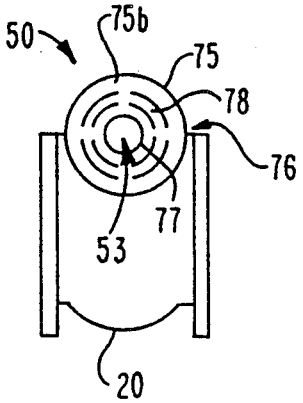

FIGS. 6A and 6B illustrate another means for providing effective exhaustion ventilation located at the air outlet of a centrifugal blower 20. As shown in FIGS. 6A and 6B, means 50 comprises a restriction means 75 having a cup-shaped form with a tubular portion **75*a* and a bottom portion 75*b* forming an effective air flow opening 53 (FIG. 6B) of less than a predetermined cross-sectional area. The air outlet 24 of said blower 20 has a tubular form and the cup shaped restriction means 75 is adapted to fit over the tubular form of the air outlet. The restriction means 75 is provided with restriction modification means 76 (FIG. 6B) comprising one or more pre-scored knock-out portions 77, 78 in the bottom portion 75*b***.

Figure 7:
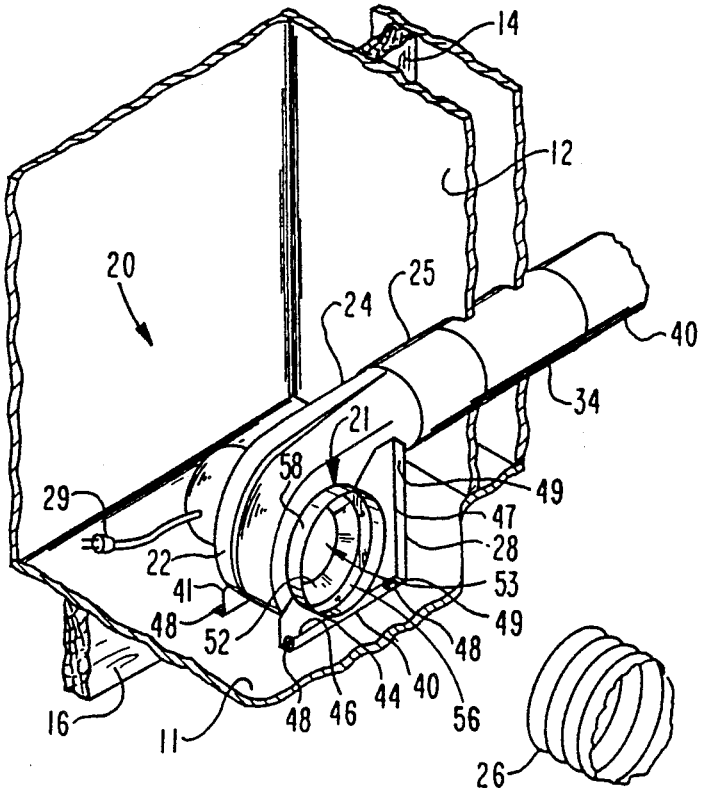
FIG. 7 is a perspective view of an installation of the blower and means for providing effective exhaustive ventilation of FIG. 2.
Figure 8:
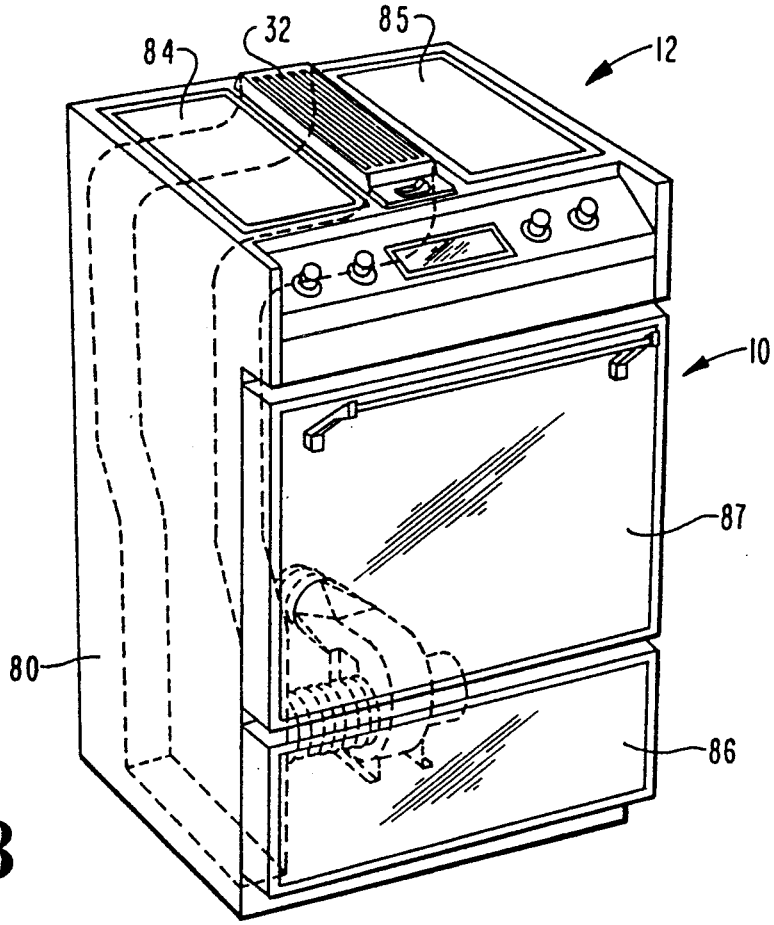
FIG. 8 is a perspective view of a completed grill range installation.

FIGS. 7 and 8 illustrate a cooking apparatus and installation method of this invention. As shown in FIGS. 2 and 7, the air producing blower 20 has been provided at its air inlet 21 with means for providing effective exhaustive ventilation.

As indicated in FIG. 1, installing a proximity ventilated cooking apparatus requires installing at a cooking location within the walls of a building a cooking apparatus 10 having an upwardly facing cooking surface 12 and an exhaustive ventilation means, or air flow circuit, including a plenum chamber 30 having an entrance 32 adjacent the cooking surface, a power driven blower 20 and an exhaust duct 40. In the invention, installation is accomplished by providing an exhaust duct running from the cooking location through the walls of the building to the outside of the building, preparing the air flow circuit of the cooking apparatus to provide effective exhaustive ventilation at said upwardly facing cooking surface and throughout said exhaust duct, securing the power driven blower to the building at said cooking location, connecting said exhaust duct to said power driven blower, and securing the cooking apparatus in place at said cooking location. As indicated below, the exhaustive ventilation means is preferably modified by removal, modification, or adjustment of the means for providing effective exhaustive ventilation in the cooking apparatus.

As shown in FIG. 7, the blower 20 includes a scroll 22 which terminates in a tangential outlet 24 and is held in place by brackets 40 and 41 which are identical. Although the air inlet 21 is shown on the right of outlet 24 in FIG. 7, air inlet 32 can be located on the left of outlet 24 if desired. Since bracket 40 is best illustrated, only bracket 40 will be described but the description is applicable to bracket 41. Bracket 40 is made up of a vertical portion 44 and two foot portions, 46 and 47 which are at right angles to portion 44 and to each other and are essentially equally spaced from the axis of the inlet of the blower. Bracket 40 may be placed with either foot portion 46 and 47 engaging floor 11 while maintaining essentially a constant alignment of the plenum outlet and blower inlet. However, since blower outlet 24 extends beyond the plane of foot portion 47 it would therefore extend through the floor 11 if blower 20 is placed with foot portion 47 engaging floor 11.

When installing the blower 20 in a through-the-wall position, as illustrated, a hole is made through wall 12 to accommodate an outlet pipe 34. It should be noted that the choice of the location of the hole in wall 12 is made with reference to the location of studs 14 and to a lesser degree to the chosen location of blower 20. The studs can be located in a conventional manner. The location chosen for the blower will be made with respect to the location of outlet pipe 34, the plenum 30 and the joists 16. The joists can be located in a conventional manner. In a typical installation an expander 25 is used between blower 20 and outlet pipe 34. Because blower 20 is connected to plenum 30 by means of flexible pipe 26, there is considerable flexibility in positioning blower 20 so that the blower can be secured to the joists 16, or not, as desired. This flexibility of positioning also permits the maintaining of sufficient clearances between the members to facilitate installation. To the extent possible, however, a straight run of pipes 25, 34 and exhaust duct 40 is desired to minimize flow resistance. As illustrated, screws 48 extend through holes 49 at foot portion 46 of the bracket 40 and are screwed into the floor 11. Bracket 41 is similarly secured.

The exhaust duct 40 is then run through the walls (in referring to walls we include floors and ceilings and roofs) of the building. If the length of the exhaust duct has an effective length in excess of 30 feet, the exhaustive ventilation means defining the air flow circuit is prepared to provide effective exhaustive ventilation. Effective length can be determined by adding, for example, an effective length of five feet for each elbow in a 6 inch exhaust duct and similar effective lengths for other restrictions. In the installation of cooking apparatus such as that shown in part in FIGS. 2 and 7, the restrictive means, or annulus 52, is pulled from the blower assembly 20. Fastener 57, through its spring loaded projections 57*a* (FIG. 2) permits easy removal of the restriction means 52.

With blower 20 secured to floor 11 and with outlet pipe 34 in place, flexible pipe 25 is set in place to connect outlet 24 with outlet pipe 34. The end of exhaust duct 40 is then connected to the outlet pipe 34. The blower 20 will then appear as illustrated in FIG. 7. Flexible pipe 26 is set in place on inlet 21 of blower 20 by placing flexible pipe 26 over coupling 58. Alternatively, flexible pipe 26 can be installed after the self-ventilated range is set in place.

The cabinet 80 of the self-ventilated range 10 will be set in place over the blower 20 and the self-ventilated range will be connected to the electrical service in a conventional manner. FIG. 8 shows a range 10 with an upwardly facing cooking surface 12 where the inlet entrance 32 to the proximity ventilation system is located in the top of range 10 between interchangeable cooktops 84 and 85. Access door 86 which is located below oven door 87 replaces the normal utensil drawer and serves to provide the necessary access for connecting the flow path. A major portion of the exhaustive ventilation means is shown in phantom lines in FIG. 8 with a blower having its air inlet at the left of the air outlet. After range 10 is set in place the access door 86 is opened to permit easy access to ventilation chamber for connecting flexible pipe 26 to the blower 20 and plenum 30 to complete the exhaust flow path between inlet grill 32 and exhaust duct 40. Since blower 20 is firmly secured to the floor 11 and is physically connected to the rest of the range only by flexible pipe 26, vibration and noise are minimized. The chamber at the bottom of range 10 is open at the back and bottom so that the range 10 may be set or slid over the previously installed blower 20. Motor 28 of the blower 20 is enabled by plugging plug 29 (FIG. 7) into the self-ventilated range's electrical system.

Although the installation method described above refers to removal of the annulus 52 of the presently preferred cooking apparatus of this invention, installations of the invention include the removal modification or adjustment of the other disclosed embodiments of the means 50 for providing effective exhaustive ventilation.

No prior known system or method provides effective exhaustive ventilation for a wide variety of installations. U.S. Pat. No. 3,756,217 shows a self-contained cooking apparatus with a variably-positioned damper to determine air flow velocity and direction at the plenum entrance and to close the entrance to prevent back drafts of outside air into the room. U.S. Pat. No. 2,085,511 shows a burner system for creating downdraft ventilation adjacent a burner including a variable damper below the burner and between the burner and an exhaust fan. U.S. Pat. Nos. 2,828,683, 3,128,938, 3,803,690, 4,253,796 and 4,456,033 show various other ventilating and fan apparatus. U.S. Pat. No. 3,803,690, for example, shows a blower with a removable ring to improve fan performance. These references do not disclose cooking systems adapted for use with exhaust ducts of variable length with means for providing effective exhaustive ventilation.

Although the description and drawings above illustrate and describe preferred embodiments of the invention, the scope of the invention is limited only by the prior art and scope of the following claims:

What is claimed is:

1. Proximity ventilated cooking apparatus including a housing having an upwardly facing cooking surface, comprising:

an air flow circuit, including a plenum chamber in said housing having an entrance adjacent said cooking surface, a power driven blower communicating with said plenum chamber including an air inlet and an air outlet and operable for drawing air across said cooking surface and into said plenum chamber to collect smoke and cooking fumes, and duct means extending from said air outlet to atmosphere;

restriction means in said air flow circuit providing an effective air flow opening of less than a predetermined cross-sectional area to limit the volume of air movement into said plenum chamber for installations in which said duct means has less than a predetermined effective length; and restriction modification means associated with said restriction means, said restriction means and said restriction modification means cooperating to provide an effective air flow opening of increased cross-sectional area to permit an increased volume of air movement into said plenum chamber for installations in which said duct means has an effective length greater than said predetermined effective length.

2. The apparatus of claim 1 wherein said restriction means is located at the air inlet of the power driven blower.

3. The apparatus of claim 2 wherein said restriction means is an annulus forming said effective air flow opening of less than a predetermined cross-sectional area, said air inlet of said blower is a hole larger than said predetermined cross-sectional area, and said restriction modification means comprises fasteners to retain said annulus in a position surrounding and reducing the cross-sectional area of said air inlet.

4. The apparatus of claim 2 wherein said restriction means comprises a perforated panel, and said restriction modification means comprises one or more fasteners to hold said perforated panel over said air inlet

5. The apparatus of claim 2 wherein said restriction means comprises a panel forming said effective air flow opening of less than a predetermined cross-sectional area and said restriction modification means comprises at least one pre-scored knock-out portion in said panel.

6. The apparatus of claim 3 wherein said air inlet is formed with a truncated conical surface, said annulus is formed as a truncated cone, and said fasteners retain said annulus nested within the truncated conical surface forming the air inlet.

7. The apparatus of claim 6 wherein said truncated conical surface forms a plurality of openings and said fasteners are spring loaded projections carried by said truncated conical surface and extending through said openings to permit the conical annulus to be pressed into and fastened in place within the truncated conical surface and pulled from within the truncated conical surface.

8. The apparatus of claim 7 wherein the pluralities of openings are elongated, and the spring loaded projections comprise a plurality of bent portions of a spring wire substantially surrounding the outside of said truncated conical surface with said plurality of bent portions projecting through said plurality of openings.

9. The apparatus of claim 1 wherein said restriction means is located at the air outlet of said power driven blower.

10. The apparatus of claim 9 wherein said restriction means has a cup shape with a tubular side portion and a bottom portion forming said effective air flow opening of less than a predetermined cross-sectional area, said air outlet of said blower has a tubular form, said cup shape being adapted to fit over the tubular form of the air outlet, and said restriction modification means comprises at least one pre-scored knock-out portion in the bottom portion.

11. The apparatus of claim 1 wherein said restriction means comprises a pair of panels, each panel forming one or more openings, with said panels being moveable with respect to one another to provide, through the overlapping positions of their one or more openings, said effective air flow opening of less than a predetermined cross-sectional area, and said restriction modification means comprises means permitting the relative movement of the pair of panels to provide said effective air flow opening of increased cross-sectional area.

12. The apparatus of claim 1 wherein said restriction means comprises a panel with one or more openings providing said effective air flow opening of less than a predetermined cross-sectional area, said panel being adapted to be carried by a removable air filter in the plenum chamber, and said restriction modification means comprises fastening means to permit the removal of the panel from the air filter.

13. The apparatus of claim 12 wherein said panel is provided with a multiplicity of perforations.

14. A method of installing a proximity ventilated cooking apparatus at a cooking location within the walls of a building, said cooking apparatus having an upwardly facing cooking surface and an air flow circuit including a plenum chamber having an entrance adjacent said cooking surface and a power driven blower, comprising the steps of:

providing an exhaust duct running from the cooking location through the walls of the building to the outside of the building;

preparing the air flow circuit of said cooking apparatus by modifying a restriction means in the air flow circuit of said cooking apparatus to provide effective exhaustive ventilation at said upwardly facing cooking surface and throughout said exhaust duct;

connecting said exhaust duct to said power driven blower; and securing said cooking apparatus in place at said cooking location.

15. The method of claim 14 wherein said restriction means is modified by adjusting a movable panel.

16. The method of claim 14 wherein said air flow circuit is modified by removing part of said restriction means.

17. The method of claim 14 wherein the air flow circuit is modified by removing the restriction means from the air inlet of the blower.

18. Proximity ventilated cooking apparatus for use within a building, comprising an upwardly facing cooking surface;

an exhaustive ventilation means for said upwardly facing cooking surface, said exhaustive ventilation means comprising an air flow passage forming means having an entrance adjacent said upwardly facing cooking surface, an air flow producing means connected to said passage forming means, and an exhaustive duct forming an air flow passage from said air producing means to the outside of the building, and means for providing effective exhaustive ventilation at said upwardly facing cooking surface and throughout said exhaustive ventilation means, said means for providing effective exhaustive ventilation comprising restriction means and means for modifying said restriction means to provide effective exhaustive ventilation.

19. The apparatus of claim 18 wherein said means for providing effective exhaustive ventilation comprises a removable restriction means located at the air inlet of the air flow producing means.

20. The apparatus of claim 19 wherein said removable restriction means is a removable annulus forming an air flow opening of less than a predetermined cross-sectional area, said air inlet of said blower being a hole larger than said predetermined cross-sectional area of said annulus.

21. The apparatus of claim 19 wherein said restriction means comprises a removable perforated panel.

22. The apparatus of claim 19 wherein said restriction means comprises a panel forming an effective air flow opening of less than a predetermined cross-sectional area and at least one pre-scored knock-out portion in said panel to increase the effective air flow opening.

23. The apparatus of claim 20 wherein said air inlet is formed with a truncated conical surface, said annulus is formed as a truncated cone, and said annulus is retained nested within the truncated conical surface of the air inlet by spring loaded fasteners.

24. The apparatus of claim 23 wherein said truncated conical surface forms a plurality of openings, and said spring loaded fasteners are carried by said truncated conical surface and extend through said openings to permit the conical annulus to be pressed into and to retained in place within the truncated conical surface and pulled from within the truncated conical surface.

25. The apparatus of claim 24 wherein the openings formed by the truncated conical surface are elongated, and the spring loaded projections comprise a plurality of bent portions of a spring wire substantially surrounding the outside of said truncated conical surface with said plurality of bent portions projecting through said plurality of openings.

26. The apparatus of claim 18 wherein said means for providing effective exhaustive ventilation comprises a restriction means located at the air outlet of said air flow producing means.

27. The apparatus of claim 26 wherein said restriction means has a cup shape with a tubular side portion and a bottom portion forming an air flow opening of less than a predetermined cross-sectional area and at least one pre-scored knock-out portion in the bottom portion, and said air outlet of said air flow producing means has a tubular form, said cup shape being adapted to fit over the tubular form of the air outlet.

28. The apparatus of claim 18 wherein said means for providing effective exhaustive ventilation comprises a pair of panels, each panel forming one or more openings, with said panels being movable with respect to one another to provide, through the overlapping positions of their one or more openings, an effective air flow opening of less than a predetermined cross-sectional area and an effective air flow opening of increased cross-sectional area.

29. The apparatus of claim 18 wherein said means for providing effective exhaustive ventilation comprises a removable panel adapted to be carried by a removable air filter and forming one or more openings providing an effective air flow opening of less than a predetermined cross-sectional area.

30. The apparatus of claim 29 wherein said panel is provided with a multiplicity of perforations.

31. A proximity ventilated cooking apparatus comprising:

an upwardly facing cooking surface, a plenum chamber having an entrance adjacent said cooking surface, a power driven blower communicating with said plenum chamber including an air inlet and an air outlet and operable for drawing air across said cooking surface and into said plenum chamber to collect smoke and cooking fumes;

restriction means in said air inlet of said power driven blower providing an effective air flow opening of less than a predetermined cross-sectional area to limit the volume of air movement into said plenum chamber; and restriction modification means at said air inlet of said power driven blower engaging, but permitting the removal of, said restriction means from said air inlet for providing an effective air flow opening of increased cross-sectional area.

32. The apparatus of claim 31 wherein said air inlet of said blower is formed with a recession having a hole larger than said predetermined cross-sectional area, and said restriction modification means retains removably said restriction means in said recession of said air inlet by deformable engagement with said restriction means.

33. The apparatus of claim 32 wherein said air inlet is formed with a truncated conical surface and said restriction modification means comprises one or more projections to deformably engage and retain said restriction means within the truncated conical surface forming the air inlet.

34. The apparatus of claim 32 wherein said restriction means is an annulus.

35. The apparatus of claim 33 wherein said truncated conical surface forms a plurality of openings and said one or more projections are spring projections carried by said truncated conical surface and extending through said openings to permit the restriction means to be pressed into and fastened in place within the truncated conical surface and pulled from within the truncated conical surface.

36. The apparatus of claim 33 wherein said restriction means is an annular truncated cone.

37. The apparatus of claim 35 wherein the pluralities of openings are elongated, and the spring loaded projections comprise a plurality of bent portions of a spring wire substantially surrounding the outside of said truncated conical surface with said plurality of bent portions projecting through said plurality of openings.

38. The apparatus of claim 31 wherein said restriction means comprises a perforated panel.

39. The apparatus of claim 31 wherein said restriction means comprises a panel forming said effective air flow opening of less than a predetermined cross-sectional area and at least one pre-scored knock-out portion in said panel.

* * * * *